US005692656A

United States Patent [19]

Dembicks

[11] Patent Number: 5,692,656

[45] Date of Patent: Dec. 2, 1997

[54] TOOL CARRIER

[76] Inventor: Andrew E. Dembicks, 5308 Boca Raton Marina Cir. North, Boca Raton, Fla. 33487

[21] Appl. No.: 657,867

[22] Filed: May 31, 1996

[51] Int. Cl.[6] ..... A45F 5/00; B65D 73/00

[52] U.S. Cl. ..... 224/249; 224/584; 224/673; 224/677; 224/904; 206/377; 206/443; 206/485; 206/806

[58] Field of Search ..... 224/249, 584, 224/673, 677, 904, 918; 206/443, 377, 378, 485, 815, 372, 806; 211/70.6

[56] References Cited

U.S. PATENT DOCUMENTS

| | | | |
|---|---|---|---|
| 470,567 | 3/1892 | Hitch . | |
| 1,927,110 | 9/1933 | Bannister et al. . | |
| 2,112,339 | 3/1938 | Kasparek | 224/249 |
| 2,503,518 | 4/1950 | Slaughter . | |
| 2,833,419 | 5/1958 | Trumpy | 211/60 |
| 2,855,107 | 10/1958 | Roth | 211/60 |
| 3,830,415 | 8/1974 | Jacobson et al. | 224/918 |
| 3,978,984 | 9/1976 | Cowley | 206/443 |
| 4,101,025 | 7/1978 | Jordan | 206/377 |
| 4,813,551 | 3/1989 | Kuo | 211/70 |
| 5,368,161 | 11/1994 | Plais | 206/369 |

*Primary Examiner*—Linda J. Sholl
*Attorney, Agent, or Firm*—Quarles & Brady

[57] ABSTRACT

A tool carrier suitable for displaying tools for merchandising includes a plurality of downwardly extending flexible strips having vertically opposed holes through which tool shafts may be inserted when the strips are flexed. Release of the flexure causes the hole walls to grip the tool shaft, firmly holding the tools for ready access and display.

11 Claims, 1 Drawing Sheet

TOOL CARRIER

FIELD OF THE INVENTION

The invention relates to tool carriers and in particular to a tool carrier suitable for both merchandising and storing tools.

BACKGROUND OF THE INVENTION

Tool sets such as hex wrenches, screw and nut drivers, and drill bits and flat wrenches are frequently stored in an index which holds the tools in a separated, orderly manner so that they can be easily selected and, in the case of cutting tools, so that the cutting edges of the tools are prevented from striking each other and being damaged. The index may, for example, be a molded plastic clam-shell case having a series of clips or holes into which are tools may be fitted.

Although such indices way work well for storing tools, their construction limits ready access to the tools. Nor are such indices well stilted for merchandising because the tools are not readily visible to the customer or well presented. Conventional tool storage indices are also relatively expensive to produce and thus substantially increase the cost of the tools to the customer.

For these reasons, tool sets, such as those described above are often sold in vinyl pouches having a clear front panel heat sealed along lines to a backer sheet so as to form a plurality of pockets into which the tools may be placed and seen.

Unfortunately, such vinyl pouches are easily damaged and thus do not serve well for storage of the tools after they are purchased. The products of combustion of vinyl are hazardous, thus making its use for packaging undesirable.

SUMMARY OF THE INVENTION

The present invention provides a tool carrier for tool sets which my serve both as a merchandising display and a storage unit for the tools after they are purchased. In the latter capacity, the invention provides ready access to the tools and may be easily carried by the user, for example, on a belt.

Specifically, the carrier includes a hanger having a transversely extending lower edge. A plurality of flexible strips having upper edges and lower edges are attached at transversely separated positions along the edges of this hanger, each strip having a pair of longitudinally separated holes sized to receive the shaft of the tool when the flexible strip is flexed into an arc along its longitudinal axis.

It is thus one object of the invention to provide a tool carrier that may also serve to display the tools for sale. The flexible strips separate and hold the tools for storage in an attractive manner for viewing by a customer. The carrier may be molded at low cost so as to not unduly increase the cost of the tool set, and yet is rugged to provide reuse and storage for the tools after they are purchased.

The hanger extends along a plane and the flexible strips are attached to the hanger to form an obtuse angle with the plane so that the shafts of the tools when inserted into the holes extend substantially parallel to the plane. The hanger my include first and second slots opposed along the transverse axis for receiving a belt.

It is another object of the invention to provide a tool carrier that has a thin profile and thus that conserves space when hung on display pegs in stores and that can be conveniently carried on a user's belt.

The foregoing and other objects and advantages of the invention will appear from the following description. In this description, reference is made to the accompanying drawings which form a part hereof and in which there is shown by way of illustration, a preferred embodiment of the invention. Such embodiment does not necessarily represent the full scope of the invention, however, and reference must be made therefore to the claims for interpreting the scope of the invention.

DESCRIPTION OF THE PREFERRED EMBODIMENT

Figure 1:
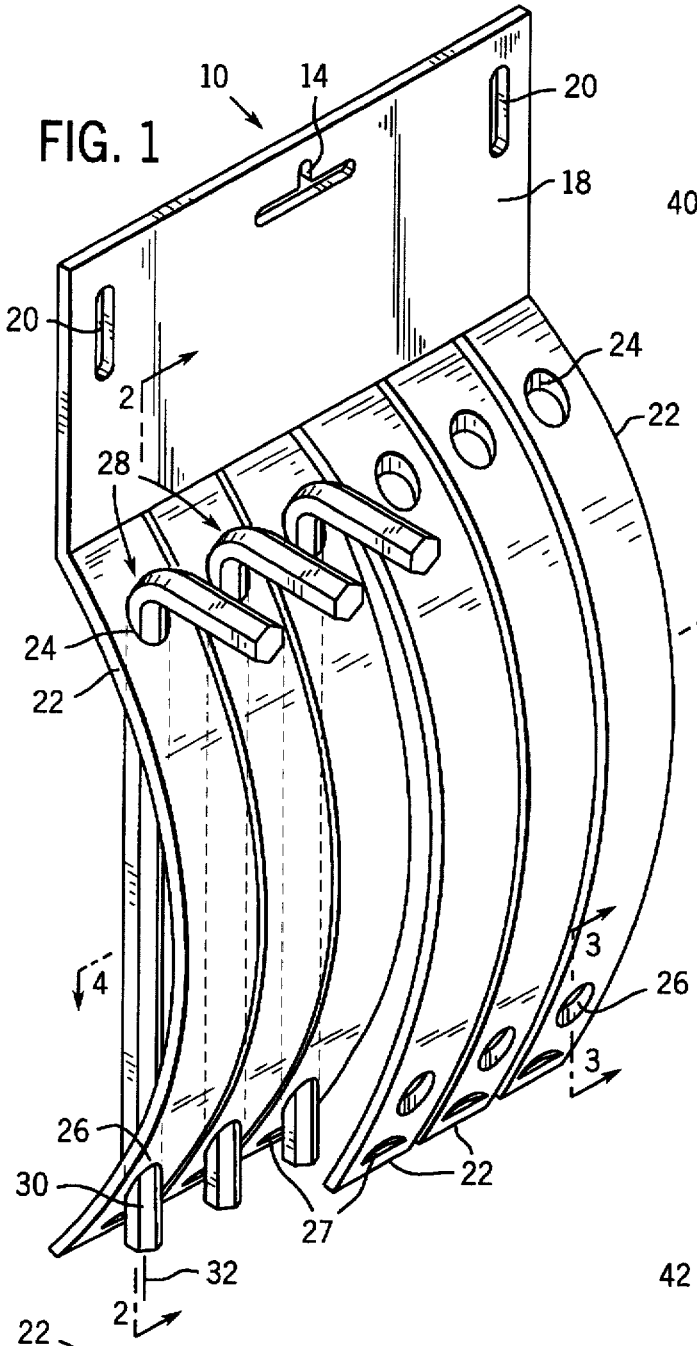
FIG. 1 is a front perspective view of the tool carrier of the present invention showing tools loaded into three carrier strips flexed into an arc to admit those tools and showing three carrier strips not loaded with tools and having less or no flexure.

Referring now to FIG. 1, a tool carrier 10 of the present invention includes a generally rectangular, planar hanger 12 having centered at an upper edge a standard hang card hole 14 for fitting on rack displays of retail merchants. The hanger 12 also includes a product label area 18 on which a label may be placed or hot stamped identifying the tools 28 loaded into the carrier 10 and a price.

At transversely opposed left and right edges of the hanger 12, there are vertically extending belt loop slots 20 which permit a user to thread his or her belt through the slots 20 so that the hanger 12 may hang vertically down from the belt allowing ready access to the tools 28 of the carrier 10 at a work site.

Attached to and extending downward from a lower transverse cage of the hanger 12 are a series of longitudinally extending carrier strips 22. Each carrier strip 22 has an upper and lower hole 24 and 26, respectively, cut through its surface, with hole 24 positioned near a top of each carrier strip 22 and hole 26 positioned near a bottom of each carrier strip 22.

Shaft portions 30 of the tools 28 may be inserted through the holes 24 and 26 when the carrier strip is flexed into an arc so that holes 24 and 26 align along an insertion axis 32. Specifically, the shaft 30 of the tool 28 is inserted from the front of the carrier strip 22 through the upper hole 24 to pass to the back of the carrier strip 22 then to be received through hole 26 and pass to the front of the carrier strip 22. When so inserted, the top and bottom of the tool 28 are dearly visible.

After the tool 28 is inserted into the carrier strip 22, and the carrier strip 22 is released, it straightens to a lesser arc thereby capturing the tool 28 against the edges of the holes 24 and 26.

At the lower edge of each carrier strip 22 is an debossment 27 which provides purchase for the fingers of the user when it is necessary to flex the carrier strip 22 to insert or remove the tools 28. To remove the tool 28, the user grasps the lower end of the carrier strip 22 at the debossment 27 (the hanger 12 being suitably restrained, for example, by the user's belt) and flexes the carrier strip 22 to realign the holes 24 and 26 reducing the fictional contact between the carrier strip 22 and the tool shaft 30 allowing the tool 28 to be easily removed.

The carrier strips 22 are generally spaced evenly along the lower transverse edge of the hanger 12, however, the transverse width of the carrier strips 22 may be varied according generally to the diameter of the shaft 30 of the tool and a possible width of a handle or the like of the tool 28. Generally the wider carrier strips 22 will provide somewhat more gripping force to the tool because of the greater spring force offered by additional area of material.

Figure 2:
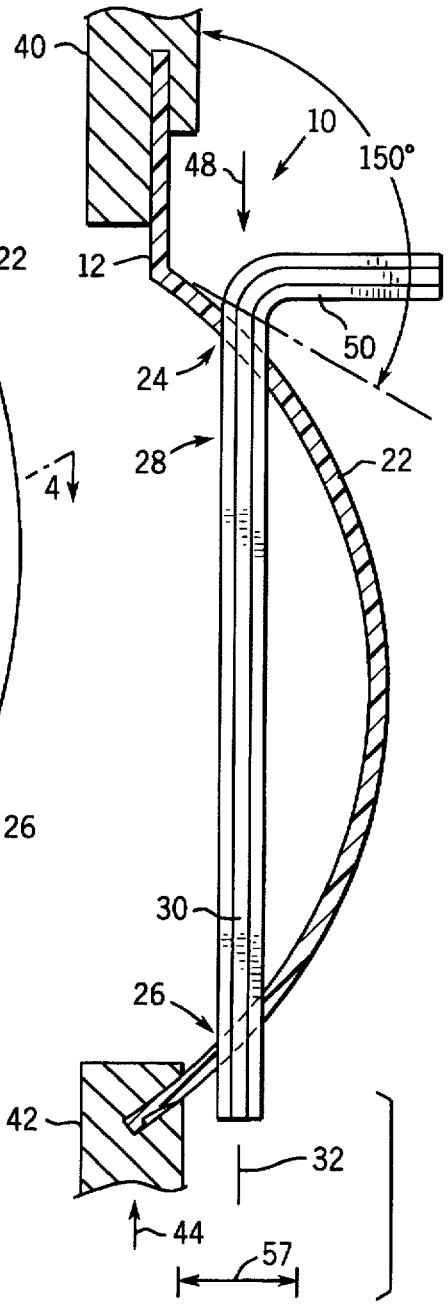
FIG. 2 is a cross-sectional view along line 2—2 of FIG. 1 showing flexure of the carrier strips by tool loading equipment to permit the insertion of tools into the tool carrier.

Referring now to FIG. 2, the hanger 12 extends along a plane and at its point of attachment to the carrier strips 22 forms an angle of approximately but not limited to 150 degrees (measured between the plane of the hanger 12 and a longitudinally extending tangent 34 starting at the point of attachment of the carrier strip 22 to the hanger 12). This angle plus the catenary arc of the carrier strip 22, when the tool 28 is inserted through holes 24 and 26, causes the tool shaft 30 to extend along the axis substantially parallel to the hanger 12. Thus the tools hang in an attractive vertical orientation when the hanger 12 is hung from the hang card hole 14. Similarly, the tools lie flat at a user's side when the hanger 12 is suspended on the user'belt through slots 20.

The initial insertion of the tool 28 into the carrier 10 is accomplished by a tool having opposed finger plates 40 and 42, finger plate 40 grasping the hanger 12 at its upper edge and finger plate 42 capturing the lower edges of the carrier strips 22. The finger plates 40 and 42 may move inward toward each other generally along the plane of the hanger 12 as held.

The finger plate 42 allows flexure of the end of the carrier strip 22 away from the plane of the plates 40 and 42 by an angle comparable to that between the hanger 12 and the upper edge of the carrier strip 22. Accordingly, as plate 42 is moved toward plate 40, the carrier strip 22 bends into a catenary arch aligning holes 24 and 26 so that the straight shaft 30 of the tool 28 may be easily inserted through these holes as described. By controlling the mount of movement of plates 40 and 42, the amount of curvature may be precisely controlled.

Each hole 24 and 26 is ellipsoidal so that when the carrier strip 22 is so flexed into an arch, the projected area of the holes 24 and 26 onto a plane perpendicular to the insertion axis 32 is substantially circular and of diameter sufficient to allow the tool to easily slide through the holes 24 and 26.

Figure 3:
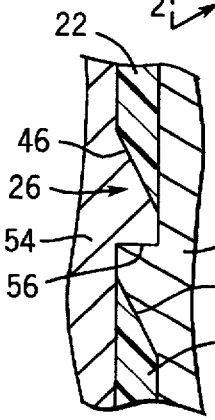
FIG. 3 is a cross-sectional view along line 3—3 of FIG. 2 through one hole in a carrier strip and showing the angled walls of the hole and the mating mold tools necessary to injection mold this hole in a simple two-part mold.

Referring now to FIG. 3, the walls 46 of the holes 24 and 26 are sloped so as to be aligned with the axis 32 when the carrier strip 22 is flexed into its proper arched shape for tool insertion.

Referring also to FIG. 2, after the shafts 10 of the tools 28 are inserted along the direction indicated by arrow 48, plates 40 and 44 are separated and the carrier strip 22 straightens as a result of its natural resilience to a lesser curvature shown generally in FIG. 1 by the carrier strips 22 not containing tools 28. This straightening causes the walls 46 of the holes 26 to press against the shafts 30 of the tool 28 gripping the tool within the holes 24 and 26 so that they do not slip out. The retention of the tools 28 in the carrier 10 is also ensured by placing any head 50 of the tool 28, too large to easily fit through the holes 24, toward the top of the carrier 10.

The holes 24 and 26 are longer in the longitudinal dimension than in the transverse dimension and in the transverse dimension they are substantially equal to the width of the shaft 30 to resist transverse looseness of the tools 28 when the tools are held in the carrier strips 22. As the carrier strips 22 straighten out, the effective projected area of the larger dimension of the holes 24 and 26 is reduced eliminating any looseness of the tool 28 forward and backward.

The carrier 10 of the present invention may be readily injection molded of polypropylene with a simple and inexpensive two-part mold. This is not only because of the generally planar aspect of carrier 10 but because all undercuts and high relief bends are eliminated. The potential undercutting of the holes 24 and 26 having sloped walls 46 is eliminated as indicated in FIG. 3 in a two-part mold having a top mold part 52 and a bottom mold part 54, by having each part extend somewhat into the holes 26 so that downwardly facing wall 46, which might be an undercut with respect to top mold part 52, may be formed by an upward projection from bottom mold part 54 and upwardly facing wall 46' which might be an undercut with respect to bottom mold part 54 may be handled by a downward projection from top mold part 52. The two mold parts 54 and 52 may join with proper relief at the center of the hole as indicated by interface 56. The carrier strips 22 may be molded flat or with a slight radius of curvature greater than that to which the carrier strips 22 must be flexed in order to permit insertion of the tool shaft 28. The longitudinal length of holes 24 and 26 arc computed to minimize merchandising height 57.

Figure 4:
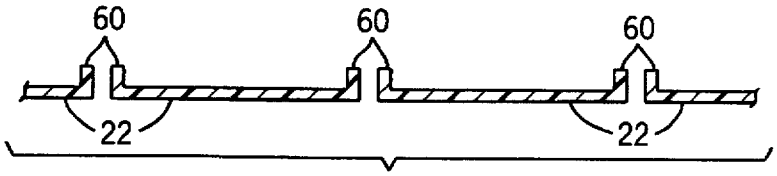
FIG. 4 is a cross-sectional view of the carrier strips of FIG. 1 taken along line 4—4.

Referring now to FIG. 4, a rear face of the downwardly extending flexible strips 22 may support outwardly extending ribs 60 giving each strip 22 a generally U-shaped cross section to increase its resistance to bending and thus to increase the force with which the holes 24 and 26 (shown in FIG. 1) grasp the tool 30.

The above description has been that of a preferred embodiment of the present invention. It will occur to those that practice the art that many modifications may be made without departing from the spirit and scope of the invention. For example, it will be recognized that the carrier 10 of the present invention may be manufactured by other means including die cutting from a single sheet of polypropylene with the holes separately die cut at angles or the sloped walls feature eliminated and thus the present invention, although readily manufactured inexpensively should not be considered limited to a particular manufacturing method. Further, a wide range of polymeric materials may be used to manufacture the carrier. Polypropylene is however preferred because of the material's inherent memory its flexure modulus, and resistance to stress cracking under load. Of course, it will be apparent that the present invention may be used with a wide variety of tools and not simply the hex wrenches shown in FIGS. 1 and 2.

In order to apprise the public of the various embodiments that may fall within the scope of the invention, the following claims are made:

I claim:

1. A carrier for tools with tool shafts, the carrier comprising:

a hanger having a transversely extending edge;

a plurality of flexible carrier strips having upper edges and lower edges opposed along a longitudinal axis, the upper edges of the carrier strips attached at transversely separated positions to the transversely extending cage of the hanger, each carrier strip further having a pair of longitudinally separated holes sized to receive the shaft of the tool when the flexible carrier strip is flexed into an arc along its longitudinal axis.

2. The carrier of claim 1 wherein the holes are ellipsoidal to project substantially to circles on a plane perpendicular to the tool shaft when the flexible carrier strips are flexed in the arc and the tool shafts are inserted through the holes.

3. The carrier of claim 1 wherein the holes have a transverse width substantially equal to the width of the tool shafts and a longitudinal width greater than the width of the tool shafts.

4. The carrier of claim 1 wherein the walls of the holes are substantially parallel to an axis extending the length of the tool shafts when the flexible carrier strips are flexed in the arc and the tool shafts are inserted through the holes.

5. The carrier of claim 1 wherein the hanger extends along a plane and wherein upper edges of the flexible carrier strips are attached to the hanger to form an obtuse angle with the plane such that the shafts of the tools extend substantially parallel to the plane when the flexible carrier strips are flexed in the arc and the tool shafts are inserted through the holes.

6. The carrier of claim 1 wherein the hanger includes a first and second longitudinally extending slot opposed along a transverse axis for receiving a belt.

7. The carrier of claim 1 wherein the hanger includes a hang card hole positioned on the center of gravity of the loaded carrier.

8. The carrier of claim 1 wherein the lower edges of the carrier strips include an debossment positioned and sized to be grasped between a user's fingers.

9. The carrier of claim 1 wherein the hanger and the flexible fingers are molded as a single thermoplastic part.

10. The carrier of claim 1 wherein the flexible fingers include ribs increasing their resistance to bending along the longitudinal axis.

11. A method of loading tools in a carrier, the tools having tool shafts, the carrier including a hanger having a transversely extending edge and a plurality of flexible carrier strips having upper edges and lower edges opposed along a longitudinal axis, the upper edges of the carrier strips attached at transversely separated positions to the transversely extending edge of the hanger, each carrier strip further having a pair of longitudinally separated holes, the method comprising the steps of:

bending the flexible carrier strips into an arc so that the longitudinally separated holes lie on a straight line axis and present an area perpendicular to the straight line axis sufficient to admit the tool shaft;

aligning the tool shaft with the straight line axis and moving the tools along the straight line axis to thread the tool shaft through both holes; and releasing the flexible carrier strips so that they may straighten and clamp the tool shaft between opposing walls of the holes.

* * * * *